US008307616B2

(12) United States Patent
Nottingham et al.

(10) Patent No.: US 8,307,616 B2
(45) **Date of Patent: *Nov. 13, 2012**

(54) SYSTEMS AND METHODS FOR FILLING A COLLAPSIBLE CONTAINER

(75) Inventors: John Nottingham, Bratenahl, OH (US); John Spirk, Gates Mills, OH (US); Nick E. Stanca, Westlake, OH (US); Jeff Kalman, Cleveland Heights, OH (US)

(73) Assignee: International Packaging Solutions LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/157,877

(22) Filed: Jun. 10, 2011

(65) Prior Publication Data

US 2011/0239594 A1 Oct. 6, 2011

Related U.S. Application Data

(63) Continuation of application No. 11/818,062, filed on Jun. 13, 2007, now Pat. No. 7,980,045, and a continuation-in-part of application No. 11/217,088, filed on Aug. 31, 2005, now abandoned.

(60) Provisional application No. 60/813,527, filed on Jun. 14, 2006.

(51) Int. Cl.
*B65B 3/04* (2006.01)

(52) U.S. Cl. ..... 53/469; 53/480; 53/485; 53/486

(58) Field of Classification Search ..... 53/469, 53/471, 473, 480, 485, 266.1, 281, 486
See application file for complete search history.

(56) References Cited

U.S. PATENT DOCUMENTS

| | | | | |
|---|---|---|---|---|
| 2,702,150 | A * | 2/1955 | Vogt | 53/570 |
| 3,674,060 | A * | 7/1972 | Ruekberg | 141/83 |
| 3,945,174 | A * | 3/1976 | Franz | 53/289 |
| 3,973,603 | A * | 8/1976 | Franz | 141/114 |
| 4,341,054 | A * | 7/1982 | Courtheoux | 53/268 |
| 5,372,000 | A * | 12/1994 | Altermatt et al. | 53/570 |
| 7,980,045 | B2 * | 7/2011 | Nottingham et al. | 53/469 |

* cited by examiner

*Primary Examiner* — Thanh Truong
(74) *Attorney, Agent, or Firm* — McDonald Hopkins LLC

(57) ABSTRACT

A system and method for filling a collapsible container are provided. Such a collapsible container may be made of a relatively rigid portion and a collapsible portion, with the collapsible portion having a collapsed condition and an expanded condition. An obstruction maintains the collapsible portion in the collapsed condition while the container is filled with contents. The obstruction may remain in place until the container is capped and sealed with the contents stored inside the container.

12 Claims, 9 Drawing Sheets

SYSTEMS AND METHODS FOR FILLING A COLLAPSIBLE CONTAINER

CROSS-REFERENCE TO RELATED APPLICATIONS

This application is a continuation of U.S. application Ser. No. 11/818,062, titled Systems and Methods for Filling A Collapsible Container, which was filed on Jun. 13, 2007 now U.S. Pat. No. 7,980,045. This application claims priority to, and the benefits of, U.S. Provisional Application No. 60/813,527, titled Systems and Methods for Filling a Collapsible Container, which was filed on Jun. 14, 2006. U.S. Provisional Application No. 60/813,527 is incorporated herein by reference in its entirety. This application is a continuation-in-part of, and claims priority to, and the benefits of, U.S. patent application Ser. No. 11/217,088, titled Semi-Collapsible Container, which was filed on Aug. 31, 2005 now abandoned. U.S. patent application Ser. No. 11/217,088 is incorporated herein by reference in its entirety.

FIELD OF THE INVENTION

The invention is generally applicable to semi-collapsible containers. More specifically, the invention is applicable to systems and methods for maintaining a semi-collapsible container in a collapsed or partially collapsed condition during a filling operation.

BACKGROUND OF THE INVENTION

Many consumer and industrial products are composed of active ingredients or concentrates dissolved in solvents, such as water. To reduce the weight and volume of such a product, the product may be offered in concentrate form, allowing the end user to add a solvent to the concentrate prior to use. Either the concentrate or the solvent may be in solid, liquid, or gaseous form, or a combination of these three. To provide the end user with a container gaseous form, or a combination of these three. To provide the end user with a container adaptable to hold the subsequently diluted product (including both the concentrate and the solvent), the concentrate may be provided in a collapsible or semi-collapsible container. Such a container minimizes packaging space in an initial collapsed state, in which only the concentrate is contained, and then expands or distends to contain the diluted product upon the addition of the solvent.

In one such container, an interior or hollow portion is defined by a relatively rigid portion including a base, sides, and a dispenser, and a collapsible portion joined with the rigid portion and movable with respect to the rigid portion between a collapsed state and a distended state. To make the collapsible portion of the container more pliable, the collapsible portion may be provided with a thinner wall thickness, or be made from a softer or more flexible material, than the more rigid portion. In doing so, the collapsible portion may be adapted to be pliable enough to automatically expand to the distended state when solvent is added to the concentrate in the container, as the filling operation provides sufficient outward force against the collapsible portion to expand the collapsible portion to the distended state.

FIGS. 1 and 2 show a representative container 100 as described in co-pending U.S. application Ser. No. 11/217,088, entitled "Semi-Collapsible Container," the entire disclosure of which is incorporated herein by reference. FIG. 1 illustrates the container 100 in a collapsed state, in which collapsible portion 130 is concave or inverted towards the interior of the container 100. FIG. 2 illustrates the container 100 in a distended state, in which the collapsible portion 130 is convex or expanded from the interior of the container 100. The collapsible portion 130 may be joined to a more rigid support portion 120 by a hinge portion 250 having one or more bends to allow the collapsible portion 130 to flex between collapsed and expanded states. In other embodiments the collapsible portion 130 may be flexible enough to not require a hinge portion, or may be constructed of an elastic material that stretches to expand when the container is filled.

Due to the flexibility of the collapsible portion 130 or hinge portion 250 of such a container 100, which allows the container to expand when filled with a solvent or other fluid, the potential exists for premature expansion or other deformation of the collapsible portion 130. This may occur, for example, when a concentrate or other substance is being deposited into the collapsed container prior to shipment to distribution or retail outlets for being sold to end users. Depositing the concentrate into the container 100 through the dispenser 140, many times done at a high rate of speed, may result in an outward force applied to the collapsible portion 130, due to, for example, an increase in the internal pressure within the container 100 or the impact of the concentrate being deposited. This may undesirably cause the collapsible portion 130 to prematurely expand or otherwise deform in an unintended fashion. This expansion or deformation may result in an increased volume and/or irregular appearance for the packaged product, potentially detracting from the space-saving and aesthetic features of the collapsible container. In addition, maintaining each container in its collapsed state helps to ensure each bottle in the assembly line has substantially the same configuration and shape. Maintaining such consistency from container to container makes the .containers more easy to handle in a mass distribution context and also helps to improve their presentation on retail shelves.

DETAILED DESCRIPTION

Figure 2:
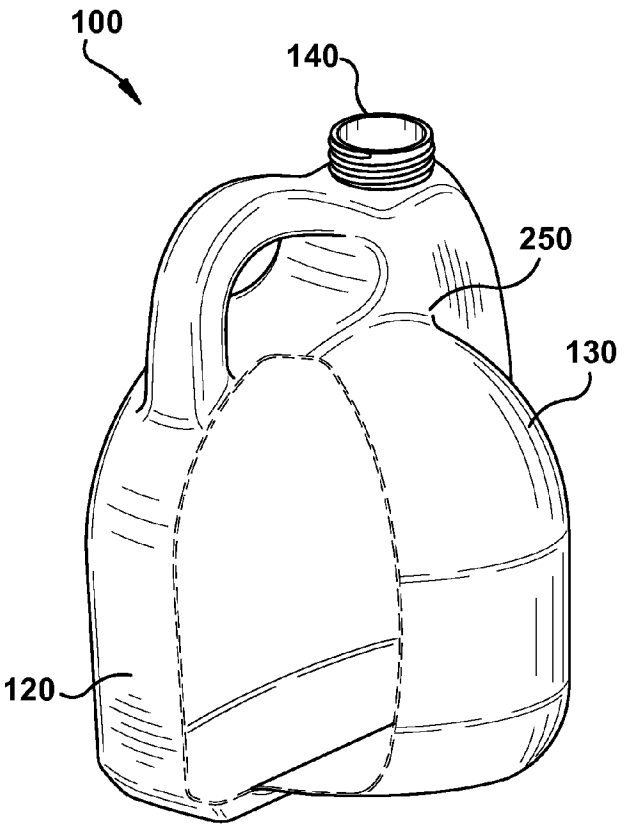
FIG. 2 shows a perspective view of the collapsible container of FIG. 1 in an expanded condition, with a portion of the container being cut away.

The present invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the Invention. As used in the description of the invention, the singular forms "a," "an," and "the" are intended to include the plural forms as well, unless the context clearly indicates otherwise.

The invention is directed, in various embodiments, to devices and methods for filling, to varying degrees, a collapsible container. As used herein, "filling" includes depositing any amount of a solid, liquid, or gaseous substance into a container. "Collapsible containers" include containers of varying degrees of collapsibility, and the terms "collapsible" and "semi-collapsible" are used to refer to any space within a container that is effectively reducible in its size or internal volume by the application of mechanical force to distort its shape, such as by inverting a portion of the container.

According to one aspect of the invention, the systems and methods for filling the collapsible container include the use of an obstruction, adapted to engage a collapsible portion of the container in a collapsed or partially collapsed state, to prevent undesired expansion or other outward movement of the collapsible portion. Such an obstruction may be engaged with the collapsible portion during filling of the container, such as, for example, when a concentrate is being deposited into the collapsed container for future dilution. Engagement of the obstruction with the collapsible portion may involve bringing the obstruction and collapsible portion into physical contact. Or, such engagement may involve merely placing the obstruction close enough to the collapsible portion such that in the event the collapsible portion begins to expand (whether or not it actually does so), such expansion will be prevented by the obstruction, and the collapsible portion will remain in its collapsed state. Once the container is capped or sealed, such as after a filling operation is complete, an air-tight seal between the container and the environment may be sufficient to prevent expansion or deformation of the collapsible portion, and the obstruction may be removed from engagement with the collapsible portion of the container.

In some instances it may be desirable to permit some expansion or outward movement of the collapsible portion during or after a filling operation. For example, such an expansion may increase the available volume within the partially collapsed container for holding concentrate. This permits using the same container design to hold varying amounts of concentrate, to allow for different solvent-to-concentrate ratios in the final solution. As a representative example, a gallon size container (in the expanded state) may be able to hold enough concentrate in the collapsed state to form a 3:1 solvent-to-concentrate solution when expanded to hold a gallon of the solution. Using the same container to form a 2:1 solvent-to concentrate solution requires storing more concentrate in the collapsed condition, which may require more available volume.

In some applications, engaging an obstruction with a collapsible portion of a container only during a filling operation may be sufficient to prevent unwanted premature deformation of the collapsible portion. In other applications, it may be desirable to engage an obstruction with the collapsible portion from a filling operation until the container is capped or sealed. In still other applications, it may be desirable to engage an obstruction with the collapsible portion through the entire filling, capping and packaging operations to avoid any undesirable deformation resulting from any impact or forces against the collapsible portion.

Figure 1:
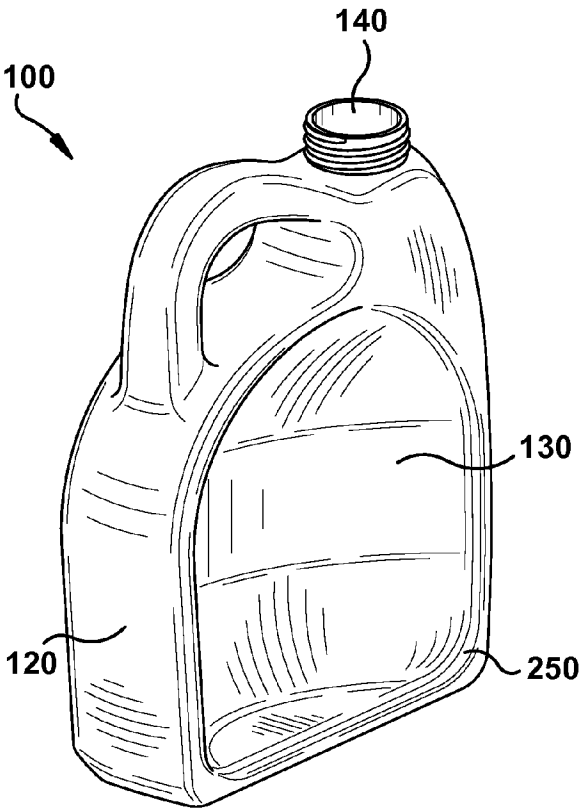
FIG. 1 shows a perspective view of a collapsible container in a collapsed condition.

It may be desirable to incorporate a device or method for maintaining the collapsed condition of a collapsed container into automated or high production packaging equipment. Such equipment may include, for example, conventional in-line and rotary conveyors, in which containers are moved through separate forming, filling, capping, and packaging stations, often in a matter of seconds. Where the collapsed portion of a container forms a concave or bowl-shaped structure, as shown in FIG. 1, engagement of a rigid obstruction with the collapsed portion may involve insertion and subsequent removal of the obstruction from the collapsed portion. As such, a flat plate or wall adjoining the conveyor, which cannot be inserted into the concave collapsed portion, may be inadequate for maintaining the collapsed condition. Also, in packaging systems in which containers are moved between stations, as is the case with many packaging systems, a stationary press, ram or other extendable obstruction may undesirably impede this movement. Such obstructions may also be bulky and/or mechanically complex.

Therefore, according to an aspect of the present invention, a packaging system may be adapted to provide an obstruction for maintaining the collapsed condition of a collapsible container, in which the obstruction is able to move with the container as the container is conveyed in a filling station, and/or between a filling station and a capping or sealing station.

Figure 3A:
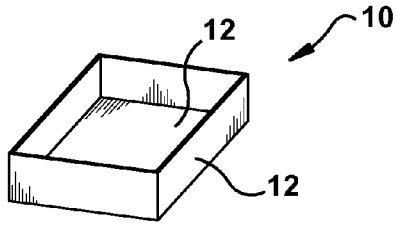
FIG. 3A shows a perspective view of a first conveyor.
Figure 3B:
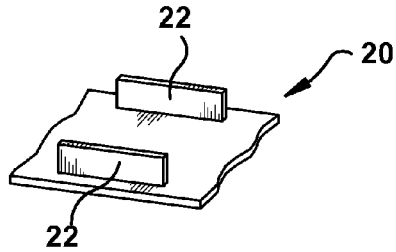
FIG. 3B shows a partial perspective view of a second conveyor.

In one such embodiment, the obstruction is affixed to a conveyor on which the container is transported. Such a conveyor may include, shown for example in FIG. 3A, a base support portion such as a tray or car 10, with upstanding walls 12 and an open top. In another embodiment, shown in FIG. 3B, the conveyor may include one or more portions of a continuous conveyor belt. Like the conveyor 10 of FIG. 3A, the conveyor 20 of FIG. 3B may include one or more support walls, ribs, or other extensions 22, to prevent a container placed on the conveyor from sliding or tipping over. Once one or more containers have been loaded onto the conveyor, conventional automated equipment may then be used to move the conveyor to and from different stations.

Figure 4A:
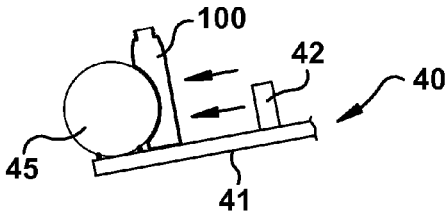
FIG. 4A shows a side cross-sectional view of a third conveyor with an obstruction in an engaged condition, as used with a collapsible container.
Figure 4B:
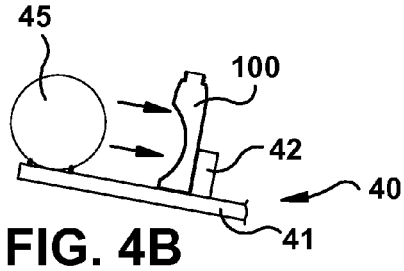
FIG. 4B shows a side cross-sectional view of the conveyor of FIG. 4A in a disengaged condition, as used with a collapsible container.
Figure 5A:
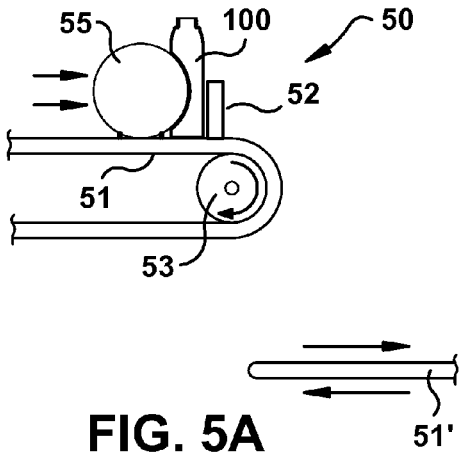
FIG. 5A shows a partial side cross-sectional view of a fourth conveyor with an obstruction in an engaged condition, as used with a collapsible container.
Figure 5B:
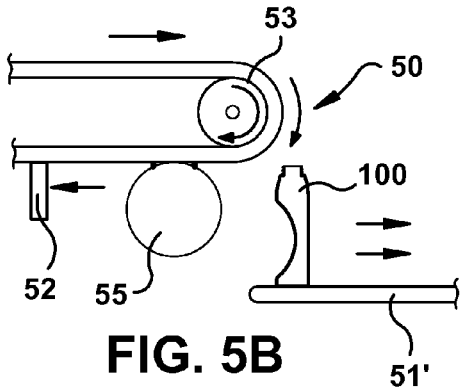
FIG. 5B shows a partial side cross-sectional view of the conveyor of FIG. 5A in a disengaged condition, as used with a collapsible container.
Figure 6:
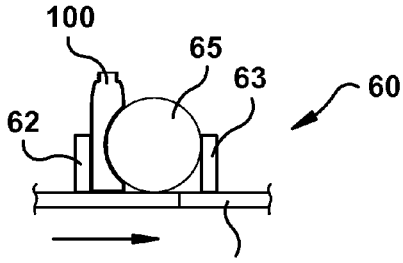
FIG. 6 shows a partial side cross-sectional view of a fifth conveyor with an obstruction in an engaged condition, as used with a collapsible container.

To enable engagement and subsequent disengagement between the container and the obstruction, the container may be moved relative to the obstruction. As one example, shown in FIG. 4A, the base portion 41 of a conveyor 40 may tilt in one direction to shift a collapsible container 100 against a fixed obstruction 45. The conveyor 40 may tilt in the opposite direction to shift the container 100 away from the obstruction 45 to be supported by side wall 42, as shown in FIG. 4B. As another example, shown in FIG. 5A, a conveyor 50 may include a first conveyor belt 51 driven by a pulley or gear 53. The conveyor belt 51 may be provided with a fixed obstruction 55 and side wall 52 for supporting a container 100. To disengage the container 100 from the obstruction 55, the conveyor belt 51 may transport the container to an edge defined by the gear 53. As the side wall 52 and obstruction 55 are driven around the gear 53 (FIG. 5B), the container 100 is dropped or transferred to a second conveyor portion 51', which may be a conveyor belt or some other conveying mechanism. The second conveyor portion may then move the container 100 to a packaging location or to some other station (not shown). As yet another example, shown in FIG. 6, a conveyor 60 may utilize a separate obstruction 65, unattached to the base portion 61 of the conveyor 60. The obstruction 65 may be wedged between the container 100 and a second side wall 63, such that the container 100 is supported by the obstruction 65 and first side wall 62.

In other embodiments, the obstruction may be selectively moved in and out of engagement with the collapsible portion. For example, the obstruction may be pivoted, flexed, expanded, or otherwise shifted into and out of engagement with the collapsible portion.

Figure 7A:
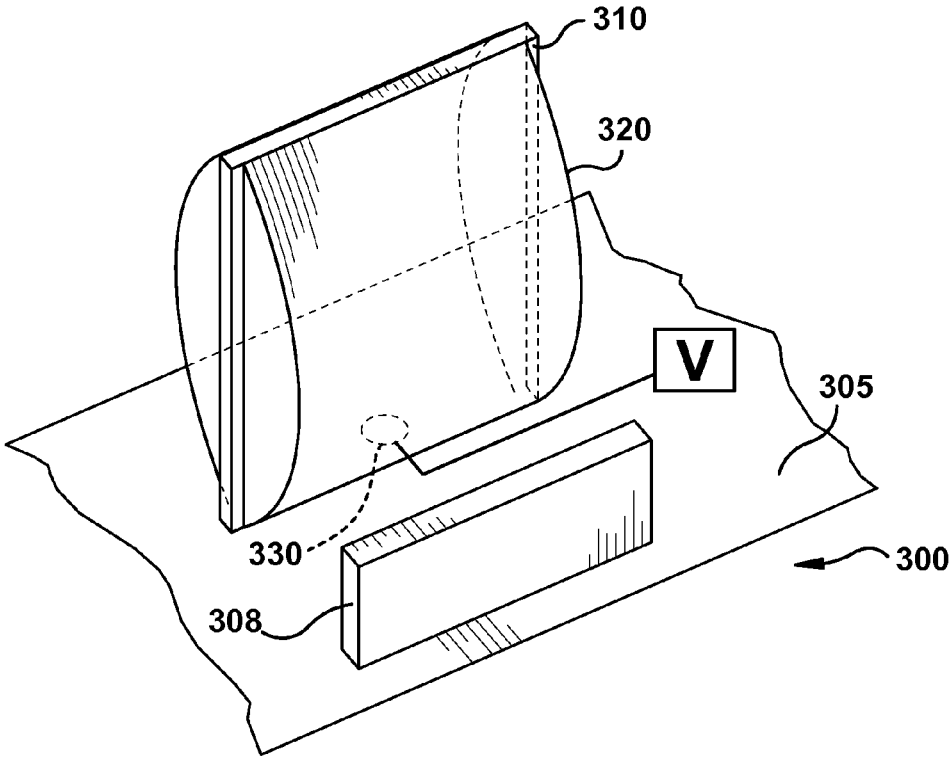
FIG. 7A shows a partial perspective view of a sixth conveyor with a movable obstruction device for use with a collapsible container.
Figure 7B:
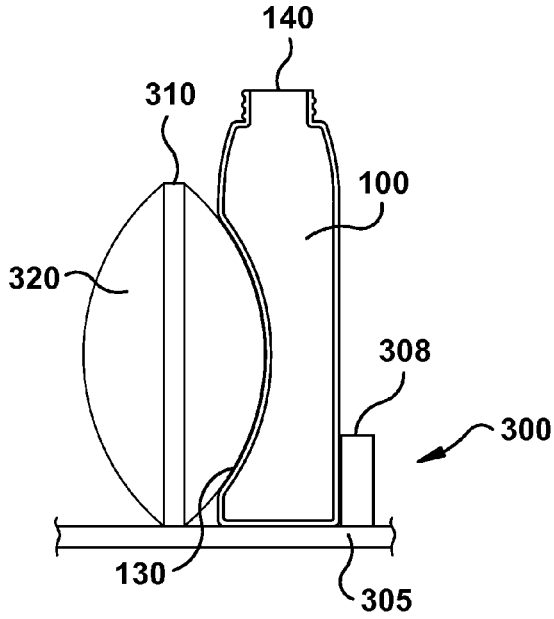
FIG. 7B shows a partial side cross-sectional view of the conveyor of FIG. 7A with the movable obstruction device in an inflated condition, as used with a collapsible container.
Figure 7C:
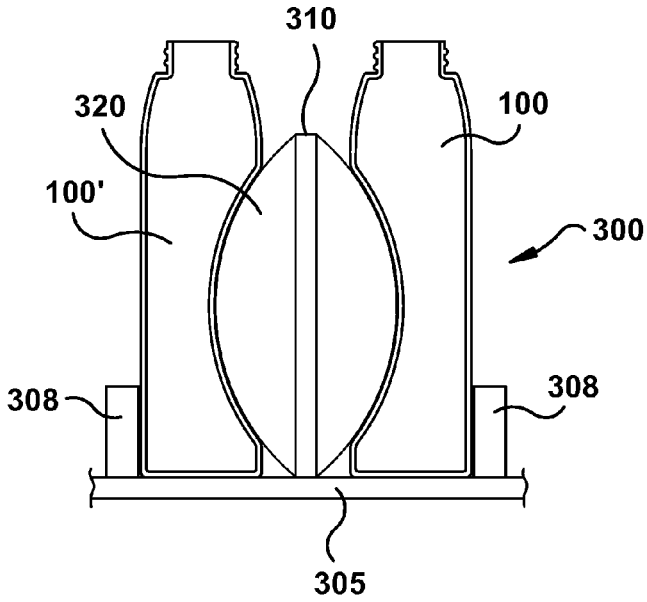
FIG. 7C shows a partial side cross-sectional view of the conveyor of FIG. 7A with the movable obstruction device in an inflated condition, as used with two collapsible containers.
Figure 7D:
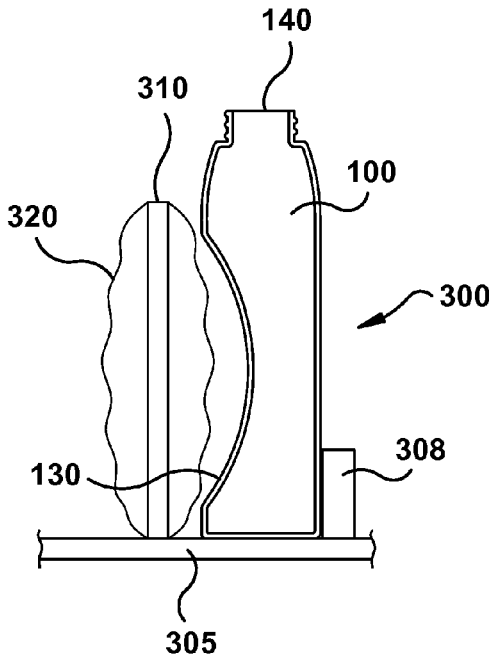
FIG. 7D is a view similar to FIG. 7B with the obstruction device in an unexpanded state.
Figure 7E:
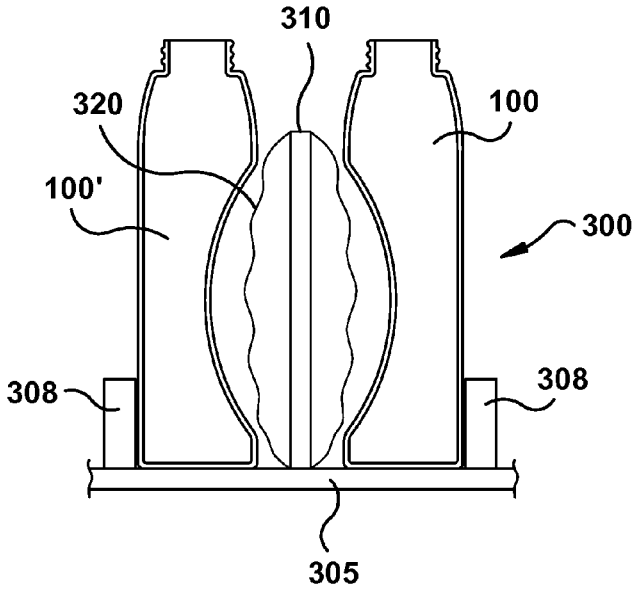
FIG. 7E is a view similar to FIG. 7C with the obstruction device in an unexpanded state.

In one such embodiment, an expandable or inflatable obstruction may be provided, wherein the obstruction engages the collapsed portion of a container in an expanded or inflated state, and the obstruction disengages the collapsed portion in an unexpanded or deflated state. FIGS. 7A-C illustrate an exemplary embodiment of such an obstruction adapted for selective engagement with a collapsible portion of a container. Referring to FIG. 7A, a frame 310, against which a collapsible container 100 (not shown) may be positioned, extends from a base portion 305 of conveyor 300. The container 100 (not shown) may be held in place between the frame 310 and one or more side walls 308. Attached to the frame 310 is a balloon-type inflatable member 320, which surrounds a port 330 in the base portion 305. As the container 100 reaches a filling station, a solenoid or other valve schematically represented by reference character "V" in FIG. 7A attached to the port 330 may be opened, allowing compressed gas to fill and expand the inflatable member 320 and bringing the inflatable member into engagement with the collapsed portion of the container, as shown in FIG. 7B. Concentrate (or any other substance) may then be deposited into the container 100 through a spout or dispenser 140 in the container 100. The engagement of the inflatable member 320 with the collapsible portion 130 of the container 100 during filling prevents the collapsible portion 130 from deforming in an undesired manner under forces resulting from the filling operation.

At the same time, varying inflation of the inflatable member 320 from container to container allows the user to control permitted deformation of the collapsed portion. As discussed above, for example, this may facilitate using the same container design to hold varying amounts of concentrate to control ratios of solvent-to-concentrate in the final solution.

As the filled container is moved from the filling station to a capping station, the inflatable member 320 may remain expanded and in engagement with the collapsed portion 130 until the container 100 is capped, maintaining the container in a collapsed state. When engagement between the inflatable member 320 and the collapsible portion 130 is no longer desired, which may be after capping the container or at any other stage during the filling, capping and packaging operations, the port 330 may be opened to atmosphere to evacuate compressed gas from the inflatable member 320, allowing the inflatable member to deflate and disengage from the collapsed portion 130 of the container 100. This disengagement allows the container to be more easily packaged, for example, by allowing the container to freely slide down an inclined conveyor or to drop into a box or crate, after filling and capping are complete.

As shown in FIG. 7C, two containers 100, 100' may be positioned on either side of the frame 310, and the inflatable member 320 may be adapted to distend into engagement with opposed collapsed portions of both containers. This may provide for more efficient use of the packaging arrangement.

Various methods may be used to inflate and deflate the inflatable member 320 through the port 330 (FIG. 7A). For example, a source of compressed gas such as air may be disposed near the filling station. A fluidic connection can then be established between the source of compressed gas and the port 330, such as with a tube, as the conveyor 300 approaches the filling station. With the valve attached to the port 330 being open, compressed gas may be forced through the port 330 and into the inflatable member 320. The valve may then be closed by interference between the valve and a closure member disposed near the conveyor's path upstream of the filling station. Similarly, an opening member may be placed near the conveyor's path downstream of the filling station, such that interference between the opening member and the valve attached to the port 330 opens the valve. One of ordinary skill will readily appreciate various other methods by which the inflatable member 320 may be inflated and deflated in conjunction with high speed automated packaging equipment, without need for human intervention.

Figure 8A:
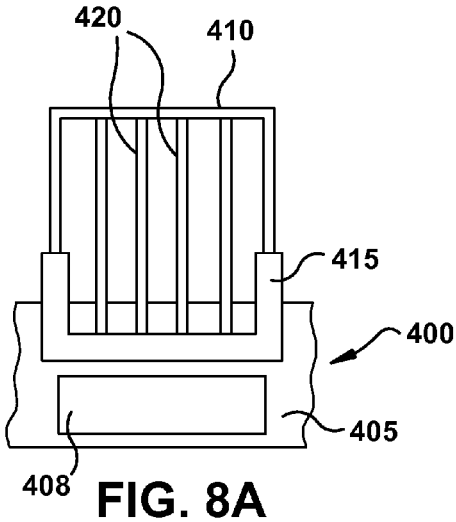
FIG. 8A shows a partial front view of a seventh conveyor with a movable obstruction device for use with a collapsible container.

In another embodiment, a flexing obstruction may be provided, wherein the obstruction engages the collapsed portion of a container by flexing into engagement with the collapsed portion, and the obstruction disengages the collapsed portion by straightening or flexing away from the collapsed surface. FIGS. 8A-D illustrate an exemplary embodiment of such an obstruction adapted for selective engagement with a collapsible portion of a container. Referring to FIG. 8A, telescoping frame members 410, 415, against which a collapsible container may be positioned, extend from a base portion 405 of a conveyor 400. The container 100 may be held in place between the frame members 410, 415 and one or more side walls 408. Attached to the frame members 410, 415 are one or more flexible members or slats 420, which are in an essentially straight or un-flexed condition when frame members 410, 415 are extended with respect to each other, as shown in FIG. 8A. As the container 100 reaches a filling station, the upper frame member 410 may be contracted into or onto the lower frame member 415 (FIGS. 8B and 8C), causing the slats 420 to bow or flex into engagement with the collapsed portion 130 of the container 100. Concentrate (or any other substance) may then be deposited into the container 100 through a spout or dispenser 140 in the container 100. The engagement of the flexed slats 420 with the collapsible portion 130 of the container 100 during filling prevents the collapsible portion 130 from deforming under forces in an undesired manner resulting from the filling operation. It may be desirable to have some relatively small amount of flexure of the slats 420 in the extended position of FIG. 8A, in the direction of the container 100, to insure they flex toward the container in the contracted positions of FIGS. 8B and 8C.

Flexure of the slats 420 may be varied to allow the user to control permitted deformation of the collapsed portion from container to container. As discussed above, for example, this may facilitate using the same container design to hold varying amounts of concentrate to control solvent-to-concentrate ratios in the final solution.

As the filled container 100 is moved from the filling station to a capping station, the frame members 410, 415 may remain in a contracted state to maintain flexure of the slats 420 against the collapsed portion 130 of the container 100. When engagement between the slats 420 and the collapsible portion 130 is no longer desired, which may be upon capping the container 100 or at any other stage during the filling, capping and packaging operations, the frame members 410, 415 may be extended, allowing slats 420 to straighten and disengage from the collapsed portion 130 of the container 100.

Figure 8B:
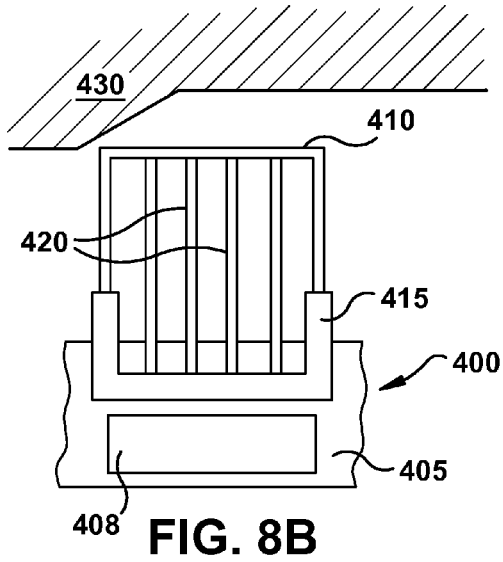
FIG. 8B shows a partial front view of the conveyor of FIG. 8A with the movable obstruction device in a flexed condition.
Figure 8C:
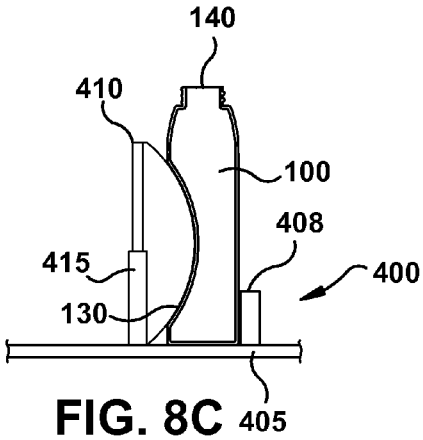
FIG. 8C shows a partial side cross-sectional view of the conveyor of FIG. 8A with the movable obstruction device in a flexed condition, as used with a collapsible container.

Many different mechanisms or arrangement may be used to contract the frame members, such as actuated pistons or gears. In one embodiment, as shown in FIG. 8B, an inclined upper surface 430, such as a track or plate, is positioned to engage upper frame member 410 to push the upper frame member downward when the container reaches the filling station. This upper surface 430 may extend to the capping station to maintain the frame members 410, 415 in the contracted state until the container is sealed. Once the upper frame member 410 disengages from the upper surface 430, springs (not shown) disposed between the frame members may return the frame members to the extended condition, straightening the slats 420 and disengaging them from the container 100.

Figure 8D:
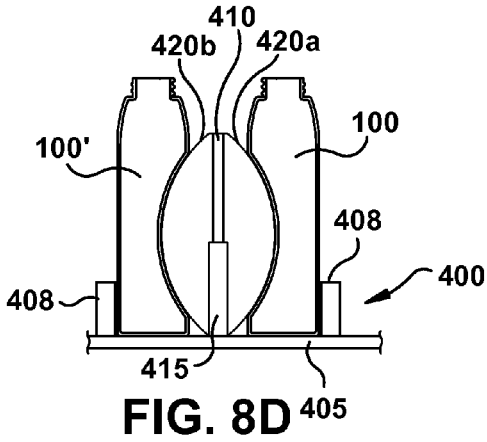
FIG. 8D shows a partial side cross-sectional view of the conveyor of FIG. 8A with the movable obstruction device in a flexed condition, as used with two collapsible containers.
Figure 8E:
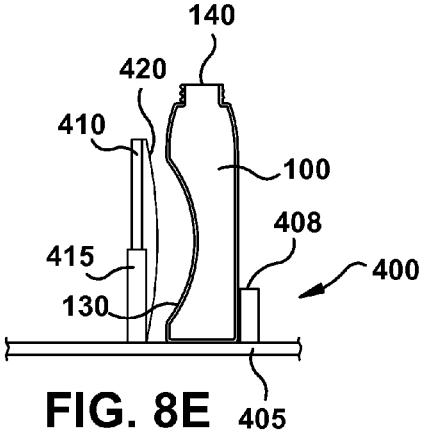
FIG. 8E is a view similar to FIG. 8C with the obstruction device in an unexpanded state.
Figure 8F:
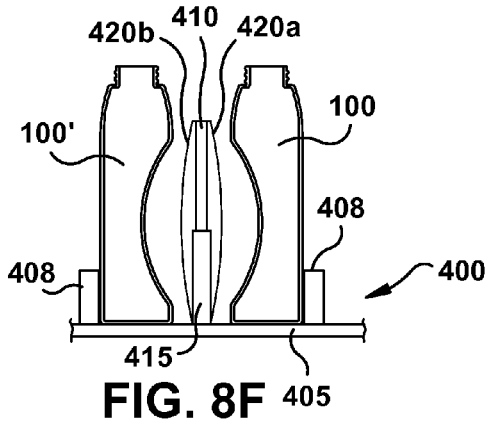
FIG. 8F is a view similar to FIG. 8D with the obstruction device in an unexpanded state.

As shown in FIG. 8D, two containers 100, 100' may be positioned on either side of the frame members 410, 415. The slats 420 may be adapted to flex in opposite directions, with some of the slats 420*a* flexing toward a first container 100 and the remaining slats 420*b* flexing toward a second container 100'. This arrangement provides engagement with opposed collapsed portions of both containers, which may provide for more efficient use of the packaging arrangement.

Figure 9B:
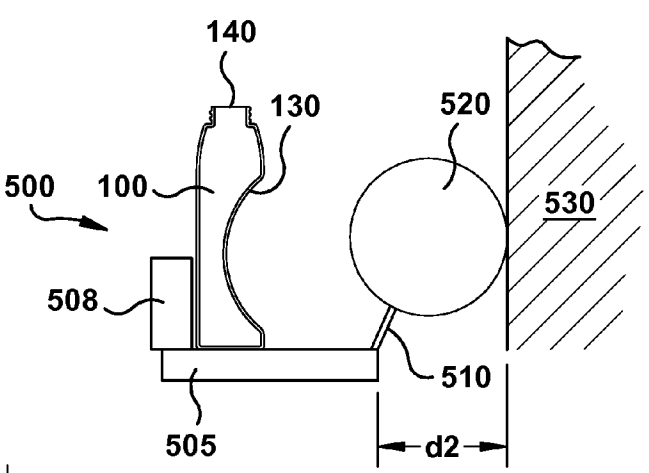
FIG. 9B shows a partial side cross-sectional view of the conveyor of FIG. 9A with a movable obstruction device in a disengaged condition, as used with a collapsible container.
Figure 9C:
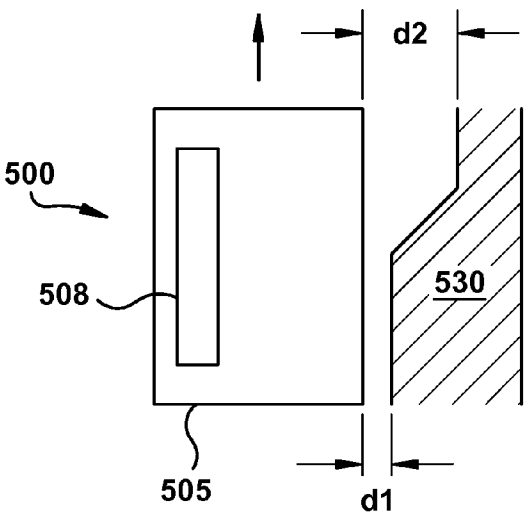
FIG. 9C shows a top view of the conveyor of FIGS. 9A and 9B, with the obstruction device cut away and the container removed.
Figure 9A:
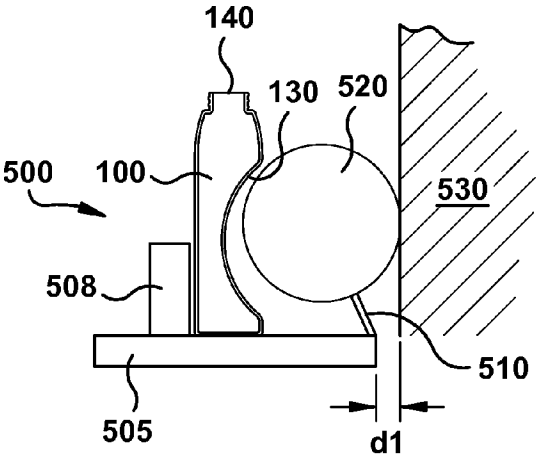
FIG. 9A shows a partial side cross-sectional view of an eighth conveyor with a movable obstruction device in an engaged condition, as used with a collapsible container.

In yet another embodiment, a pivoting obstruction may be provided, wherein the obstruction engages the collapsed portion of a container by pivoting into engagement with the collapsed portion, and the obstruction disengages the collapsed portion by straightening or flexing away from the collapsed surface. FIGS. 9A-9C illustrate an exemplary embodiment of such an obstruction adapted for selective engagement with a collapsible portion of a container. A rigid obstruction, such as, for example, the ball shaped obstruction 520 of FIGS. 9A-B, may be pivotally attached to a portion 505 of a conveyor 500 on which a container 100 is supported. The obstruction 520 may be either directly connected to the conveyor 500, or connected by a linking member 510, as shown in FIGS. 9A-B. As the container 100 reaches a filling station, the obstruction 520 may be pivoted into engagement with the collapsed portion 130 of the container 100. As the filled container is moved from the filling station to a capping station, the obstruction 520 may remain pivoted against the container 100 to hold the filled container in the collapsed condition. Once the container is capped, the obstruction may be pivoted away from the container 100 to disengage from the collapsed portion.

Many different mechanisms or arrangements may be used to pivot the obstruction into and out of engagement with the container, such as motorized mechanisms or a contoured track on the conveyor which guides the linking member. In one embodiment, shown in FIGS. 9A-9C, an angled side surface 530, such as a plate or wall, is positioned a first distance d1 from the conveyor 500 to engage the obstruction 520 to push the obstruction toward the container 100 when the container reaches the filling station. This side surface 530 may extend to the capping station to maintain engagement between the obstruction 520 and the container 100 until the container is sealed. Once the side surface 530 is disposed at a greater distance d2 from the conveyor 500, the obstruction 520 may pivot away from the container 100 through any number of mechanisms, such as a spring-loaded linking member.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the described invention.

Figure 10:
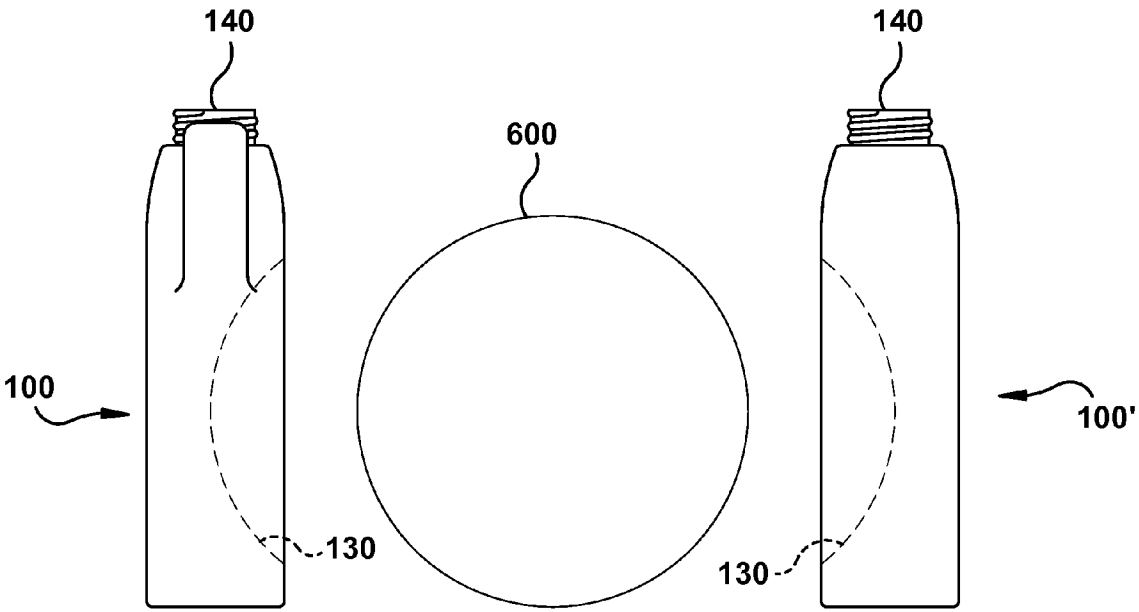
FIG. 10 shows a front perspective view of another embodiment of an obstruction with two containers, in an unassembled condition.

For example, it is not necessary that the obstruction be attached or otherwise mounted to a conveyor. Thus, another embodiment as shown for example in FIG. 10 includes a round-shaped obstruction 600 which is held between two containers 100, 100'. When the two containers are tied or otherwise held together with the obstruction 600 in between, the obstruction will extend into the concavities defined by the collapsible portions 130 of the respective containers. These two containers 100, 100 can then be packaged and shipped together as a unit, if desired. The obstruction 600 will thus maintain both containers in their collapsed condition until they are untied or otherwise pulled apart from each other, at which time the obstruction 600 may be re-used or discarded.

Figure 11:
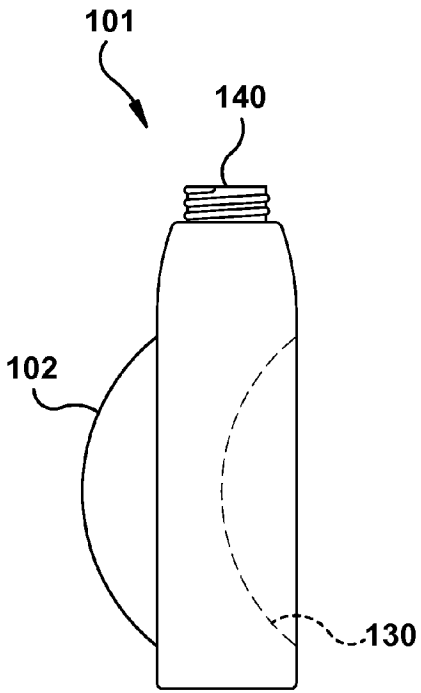
FIG. 11 shows a front perspective view of yet another embodiment, in which one container may act as the obstruction for an adjacent container.

In yet another alternative embodiment, the container 100 of FIGS. 1 and 2 may be modified so that a convex bulbous portion extends out of the side of the container opposite from the collapsible portion. This is shown, for example, in FIG. 11. The container 101 of FIG. 11 is identical to the container 100 of FIG. 1 except that it has a convex portion 102 on the face of the rigid support portion 120 opposite the collapsible portion 130. Two containers 101, 101' may then be placed side-by-side, with the convex portion 102 of one container 101 fitting into the concave collapsible portion 130 of the adjacent container 101' (not shown). With this and similar embodiments, of course, any number of containers 101, 101', 101", . . . may be held side-by-side to be filled, capped and perhaps even shipped as one unit. A separate obstruction similar to the obstruction 600 may be used to maintain the collapsed condition of the container on the end of such an assembly, if desired.

We claim:

1. A system for filling a collapsible container, wherein the collapsible container comprises a rigid portion and a collapsible portion, and the rigid portion of the container includes a dispenser through which contents may be added to or removed from the container, the system comprising:

a filling station where contents are added to the container through the dispenser, and a capping station where a cap is placed on the container;

a conveyor for transporting the container from the filling station to the capping station; and an obstruction mounted to the conveyor which engages the collapsed portion of the container at least when the conveyor is located at the filling station;

wherein the obstruction comprises an expandable member which engages the collapsed portion of the container in an expanded state as the container is moved from the filling station to the capping station, and disengages from the collapsed portion of the container in an unexpanded state after the cap is placed on the dispenser of the container at the capping station.

2. The system of claim 1 wherein the expandable member comprises an inflatable member which inflates to form the expanded state and deflates to form the unexpanded state.

3. The system of claim 1 wherein the conveyor further comprises a valve through which the inflatable member is inflated and deflated.

4. The system of claim 3 wherein the conveyor further comprises a frame and a sidewall, such that the container is held in place on the conveyor between the frame and the sidewall, and the inflatable member is attached to the frame.

5. The system of claim 1 wherein the obstruction comprises a flexing member having a flexed state which engages the collapsible portion of the container at least when the conveyor is located at the filling station, and a substantially straightened state which does not engage the collapsible portion.

6. The system of claim 5 wherein the flexing member is mounted to telescoping frame members.

7. A system for filling a collapsible container, wherein the collapsible container comprises a rigid portion and a collapsible portion, and the rigid portion of the container includes a dispenser through which contents may be added to or removed from the container, the system comprising:

a filling station where contents are added to the container through the dispenser, and a capping station where a cap is placed on the container;

a conveyor for transporting the container from the filling station to the capping station;

an obstruction mounted to the conveyor which engages the collapsed portion of the container at least when the conveyor is located at the filling station; and wherein the obstruction comprises a flexing member having a flexed state which engages the collapsible portion of the container at least when the conveyor is located at the filling station, and a substantially straightened state which does not engage the collapsible portion.

8. The system of claim 7, wherein the obstruction comprises an expandable member which engages the collapsed portion of the container in an expanded state as the container is moved from the filling station to the capping station, and disengages from the collapsed portion of the container in an unexpanded state after the cap is placed on the dispenser of the container at the capping station.

9. The system of claim 8 wherein the expandable member comprises an inflatable member which inflates to form the expanded state and deflates to form the unexpanded state.

10. The system of claim 7 wherein the conveyor further comprises a valve through which the inflatable member is inflated and deflated.

11. The system of claim 10 wherein the conveyor further comprises a frame and a sidewall, such that the container is held in place on the conveyor between the frame and the sidewall, and the inflatable member is attached to the frame.

12. The system of claim 7 wherein the flexing member is mounted to telescoping frame members.

* * * * *